US006079470A

United States Patent [19]

Pielke et al.

[11] Patent Number: 6,079,470

[45] Date of Patent: Jun. 27, 2000

[54] APPARATUS FOR CUTTING A WEB OF PAPER AND FOR APPLYING AN ADHESIVE TAPE TO THE CUTTING EDGE OF THE WEB OF PAPER

[75] Inventors: Rudolf Pielke, Hamburg; Gustav Alfons Gnan, Vilseck, both of Germany

[73] Assignee: BHS Corrugated Maschinenund Anlagenbau GmbH, Weiherhammer, Germany

[21] Appl. No.: 09/063,777

[22] Filed: Apr. 22, 1998

[30] Foreign Application Priority Data

Apr. 23, 1997 [DE] Germany ..... 197 17 078

[51] Int. Cl.[7] ..... B32B 31/00; B65H 19/00

[52] U.S. Cl. ..... 156/523; 156/506; 156/530; 156/576; 156/577; 242/553; 242/556

[58] Field of Search ..... 156/530, 527, 156/523, 518, 505, 506, 574, 576, 577; 242/553, 556

[56] References Cited

U.S. PATENT DOCUMENTS

| | | | |
|---|---|---|---|
| 1,864,478 | 6/1932 | Ward | 156/254 |
| 5,902,448 | 5/1999 | Stettner | 156/510 |

FOREIGN PATENT DOCUMENTS

| | | |
|---|---|---|
| 0181280 | 5/1986 | European Pat. Off. . |
| 1 461 239 | 11/1968 | Germany . |
| 295 20 886 U | 6/1996 | Germany . |
| 2196317 | 4/1988 | United Kingdom . |
| WO 96/02450 | 2/1996 | WIPO . |

*Primary Examiner*—Richard Crispino
*Assistant Examiner*—Linda L Gray
*Attorney, Agent, or Firm*—Browdy and Neimark

[57] ABSTRACT

An apparatus for cutting a web of paper and for applying an adhesive tape to a cutting edge of the web of paper has a stand, a receptacle, and a cutter. An applicator unit is provided, which is displaceable in a working direction. The applicator unit has a cutting device, an adhesive tape carrier and a pressing device disposed downstream (as referred to the cutting direction) of the cutting device for pressing the adhesive tape on the end of the web of paper.

38 Claims, 3 Drawing Sheets

APPARATUS FOR CUTTING A WEB OF PAPER AND FOR APPLYING AN ADHESIVE TAPE TO THE CUTTING EDGE OF THE WEB OF PAPER

BACKGROUND OF THE INVENTION

1. Field of the Invention

The invention relates to an apparatus for cutting a web of paper and for applying an adhesive tape to the cutting edge of the web of paper.

2. Background Art

In the continuous working of webs of paper, for instance during the production of corrugated board, it is necessary to join the uncoiled webs of paper by their ends for continuous working to be possible. It is in particular desirable to joint the end of the webs of paper that are to be united, i.e. to butt-joint and unite them by means of an adhesive tape. Adhesive tapes are available, which are single-face lined by an adhesive layer and have a structure similar to paper. In the case of a butt joint, a so-called flying splice, there is no need for this part to be cut out during subsequent working. A drawback resides in that such a butt joint can only be produced manually. In particular manual implementation is very complex, owing to the required accuracy of the butt joint. Because of these complex implementation, only a lapping joint has been used in practice between the ends of two webs of paper to be united, as a result of which this joint section had to be cut out in the subsequent working process.

SUMMARY OF THE INVENTION

It is an object of the invention to embody an apparatus of the generic type by means of which a butt joint is prepared between two webs of paper to be annexed to each other.

According to the invention, this object is attained in an apparatus for cutting a web of paper and for applying an adhesive tape to the cutting edge of the web of paper, which comprises a stand having a horizontal guide rail; a receptacle for a roll of paper a cutter and applicator unit which is displaceable on the guide rail in a working direction and which comprises a cutting device for producing a straight cutting edge at the end of the web of paper; an adhesive tape carrier having a wind-off device for an adhesive tape roll; and a pressing device, disposed downstream of the cutting device referred to the working direction, for pressing the adhesive tape which projects over the cutting edge on the end of the web of paper.

By the measures according to the invention, the end of a web of paper that is to be annexed to a preceding web of paper is provided with a straight cutting edge by a crosswise strip being severed and an adhesive tape is applied to this end of the paper web in the vicinity of this cutting edge, the adhesive tape projecting over the cutting edge and thus ensuring a butt joint to the end of a preceding web of paper.

Further features, advantages and details of the invention will become apparent from the ensuing description of an exemplary embodiment, taken in conjunction with the drawing.

DESCRIPTION OF THE PREFERRED EMBODIMENT

Figure 1:
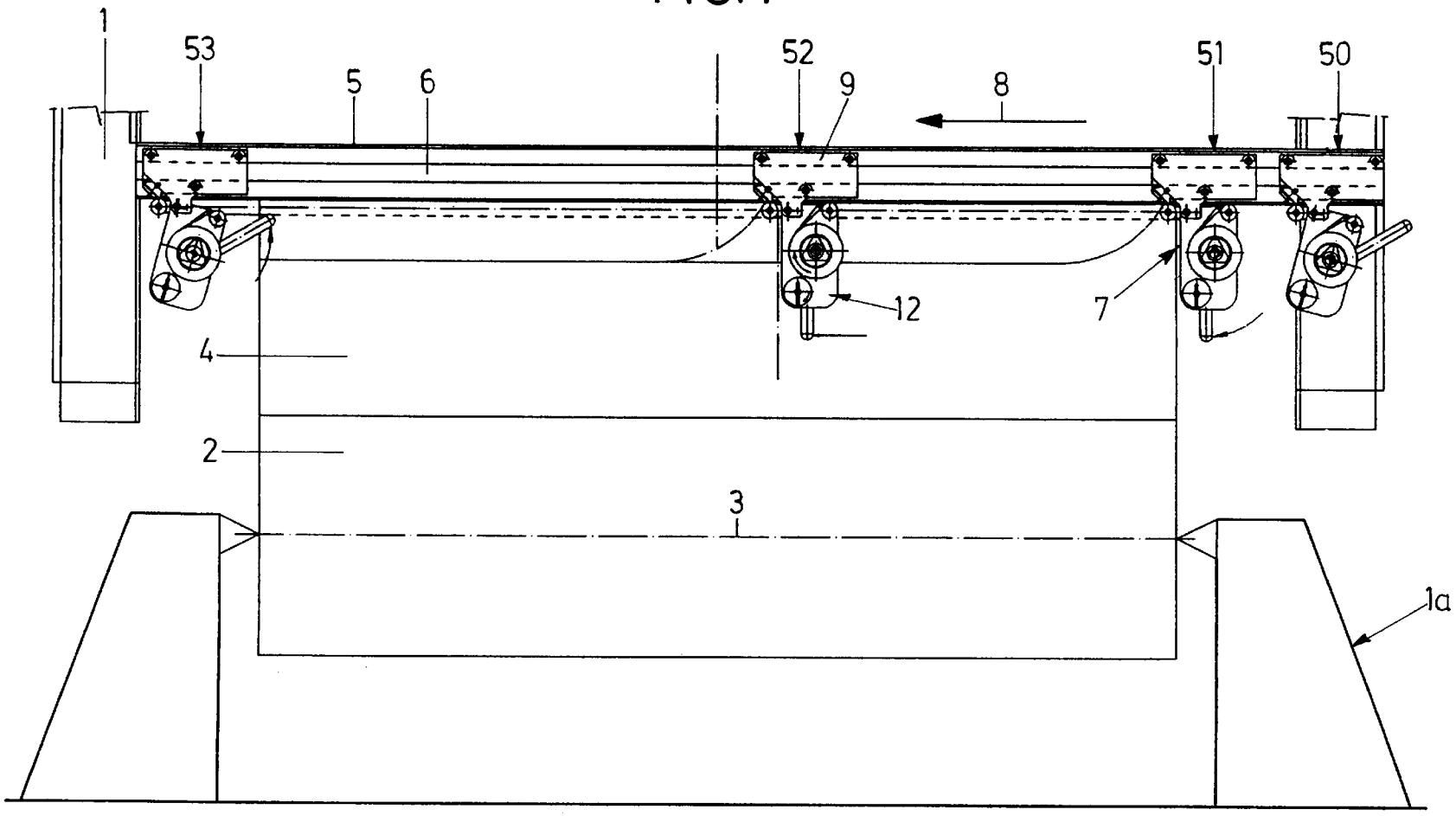
FIG. 1 is an illustration of an apparatus according to the invention.

The apparatus seen in the drawing for cutting a web of paper and applying an adhesive tape to the cutting edge of a web of paper comprises a stand 1, on which a roll of paper 2 is mounted in a receptable 1*a* for rotation about an axis 3 so that a web of paper 4 can be wound off the roll 2. The stand 1 comprises an upper horizontal transverse beam 5, to which a guide rail 6 is attached, which is parallel to the axis 3.

A cutter and applicator unit 7 is mounted on the guide rail 6, displaceably in a working direction 8 and opposite thereto. To this end, the unit 7 possesses a guide block 9 which is mounted on guide rollers 10 on the guide rail 6 to be free from play but displaceable. A slide handle 11 is attached to the guide block 9, by means of which displacement, free from tilting, of the guide block 9 and thus of the unit 7 is possible on the guide rail 6.

Figure 2:
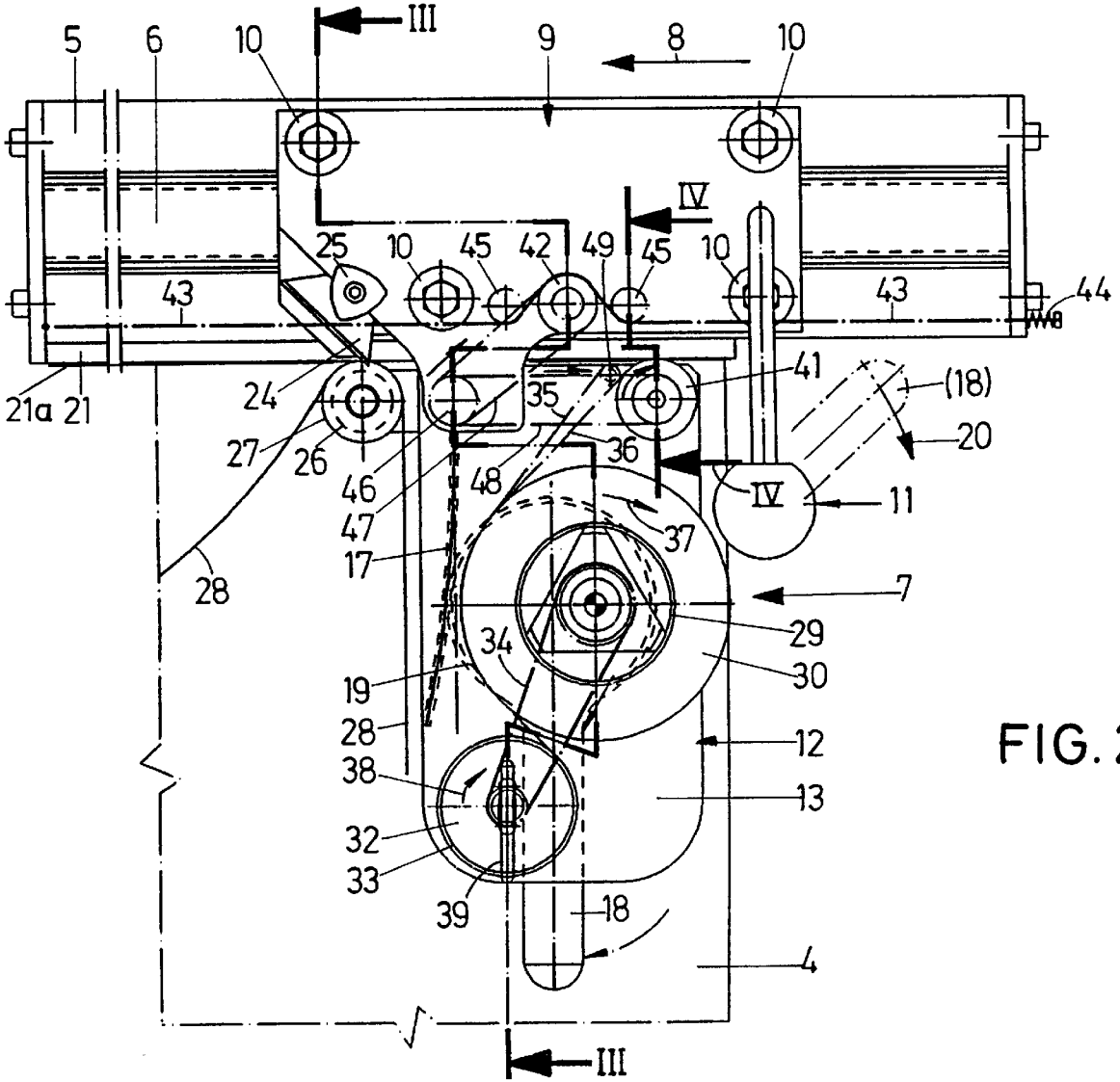
FIG. 2 is an illustration, on a strongly enlarged scale as compared to FIG. 1, of a cutter and applicator unit.

The unit 7 further comprises an adhesive tape carrier 12 which comprises a support plate 13 fixed to the guide block 9 pivotally about a pivot bearing 14. This pivot bearing 14 is located in the front portion—referred to the working direction 8—of the support plate 13. A pivot mechanism 15 is provided for the support plate 13 to be pivoted and comprises a spiral spring 17 in the shape of a rod which is tightly connected with the guide block 9 on a bearing bolt 16, fixed to the latter, of the pivot bearing 14 and which extends vertically downwards. An eccentric 19 to be actuated by means of a lever 18 bears against this spiral spring 17. When the lever 18 is in an upward position dot-dashed in FIG. 2, then the support plate 13 is pivoted clockwise about the pivot bearing 14 into its position of rest 50 as seen in FIG. 1 on the extreme left and right. But when the lever 18 is being moved in the pivoting direction 20, i.e. clockwise, downwards into a vertical position, then the support plate 13 is moved upwards in the opposite sense, i.e. counter-clockwise, into its working position seen in FIG. 2 and illustrated by the two central positions in FIG. 1.

Mounted on the underside of the transverse beam 5 is a pressing rail 21, against the underside of which bears the end 22 of the web of paper 4. The underside of the pressing rail 21 is provided with a coating 21*a*, for instance in the form of a film, of an adhesive rejecting material. This can for instance be polytetrafluoroethylene. A clamping bar 23 is mounted on the pressing rail 21, clamping and holding, between itself and the pressing rail 21, the end 22 of the paper web 4 once it has been threaded in.

A cutting knife 24 is mounted on the guide block 9—at the front seen in the working direction 8; it can be tightened or released, and thus replaced, by means of a manually operated clamping device 25. The cutting knife 24 engages with a peripheral groove 26 of a support pulley 27 which bears against the pressing rail 21 and forces the end 22 of the paper web 4 against the pressing rail 21. When the unit 7 is displaced along the guide rail 6 in the working direction 8, a crosswise strip 28 is cut off the end 22 of the paper web 4 by means of the cutting knife 24, which gives an accurately straight cutting edge 22*a* at the end 22.

A roll carrier 29 for an adhesive tape roll 30 equipped with a brake 31 is mounted on the support plate 13. A roll carrier 32 for a liner tape roll 33 is mounted underneath the roll carrier 29. By means of a belt drive 34, the roll carriers 29 and 32 are drivably connected with each other, having slippage so that when an adhesive tape 36 provided with a liner tape 35 is wound off the adhesive tape roll 30, the rotary motion in the direction of rotation 37 of the adhesive tape roll 30 is conferred to the roll carrier 32 of the liner tape roll 33, the roll carrier 32 being driven in the direction of rotation 38. A clamping bow 39 is removably pushed into the liner tape roll 33, its outer leg 40 bearing against the circumferential surface of the liner tape roll 33 so that the liner tape 35 that is to be wound on the liner tape roll 33 can be clamped under this outer leg 40.

On the top side of the support plate 13, i.e. at the rear—referred to the working direction 8—a pressing pulley 41 is rotatably mounted thereon, by means of which, in the working position of the adhesive tape carrier 12, the adhesive tape 36 is pressed against the end 22 of the web of paper 4 in such a way that the adhesive tape 36, which is provided with an adhesive layer on one side and which, only on this side, is provided with the removable liner tape 35, projects over the cutting edge 22*a*. The pressing pulley 41 is drivable. To this end, a driving pulley 42 is rotatably mounted on the guide block 9, bearing against a drive belt 43. This belt 43 is fixed to both ends of the transverse beam 5 and is kept under sufficient tensile stress by means of a tension spring 44. On both sides of the driving pulley 42, deflection pulleys45 are mounted on the guide block 9, which are disposed in such a way that the driving belt 43 slung around them and around the driving pulley 42 rests on the driving pulley 42 by a sufficiently wide angle of belt contact. Thus, the driving pulley 42 is driven upon displacement of the unit 7 along the guide rail 6. An intermediate pulley 46, which is rotatably mounted on the guide block 9 coaxially to the pivot bearing 14, is driven by this driving pulley 42 by means of a belt drive 47. The pressing pulley 41 is again driven by this intermediate pulley 46 by means of a belt drive 48. The ratios of transmission from the driving pulley 42 via the belt drives 46 and 48 to the pressing pulley 41 are chosen such that upon displacement of the unit 7 in the working direction 8, the pressing pulley 41 bears against the pressing rail 21 in a non-slip manner. The pressing pulley 41 is preceded by a return pulley 49 for the liner tape 35 which is mounted freely rotatably on the support plate 13.

Figure 3:
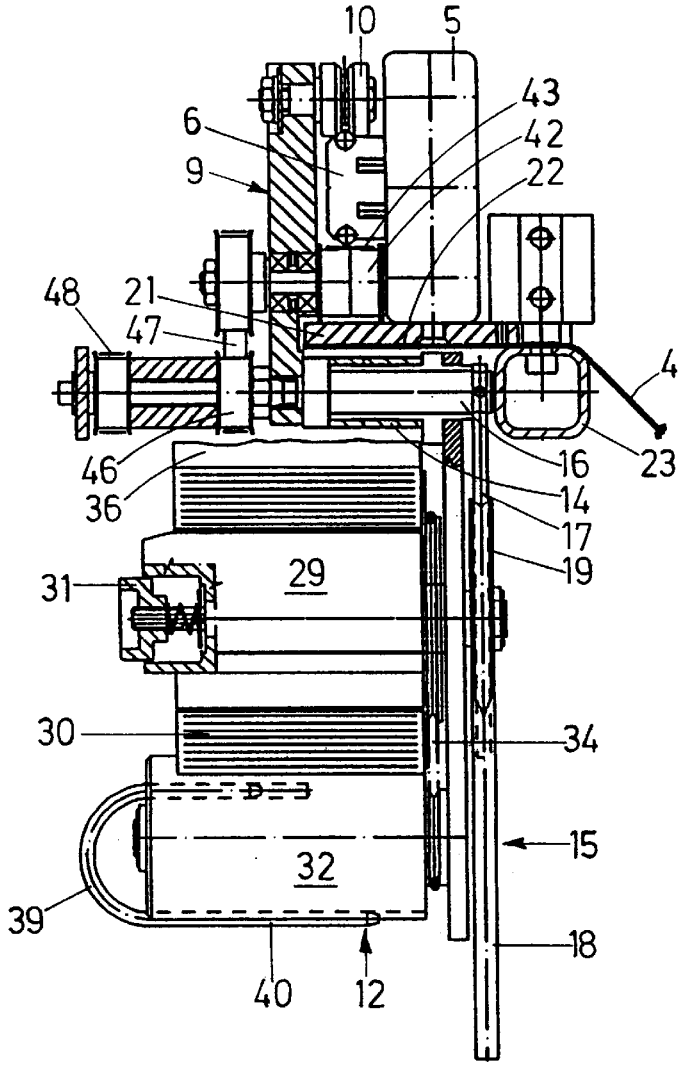
FIG. 3 is a cross-section through FIG. 2 on the section line III—III of FIG. 2.
Figure 4:
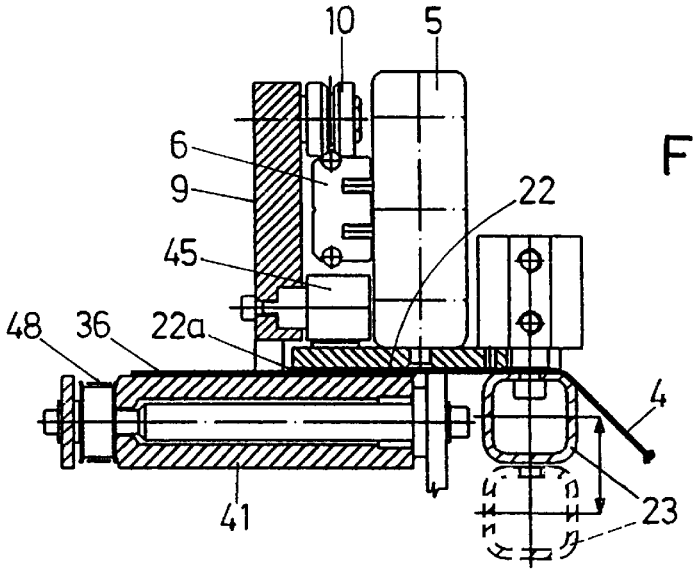
FIG. 4 is a cross-section through the apparatus on the section line IV—IV of FIG. 2.

The function is as follows:

In its initial position of rest 50, the cutter and applicator unit 7 is in its position of rest seen on the right in FIG. 1 and into which the pressing rail 21 does not reach. The end 22 of the web of paper 4 is pulled over the clamping bar 23 in the way described. An adhesive tape roll 30 is situated on the adhesive tape carrier 12. The adhesive tape 36 which is provided with a liner tape 35 is threaded between the return pulley 49 and the pressing pulley 41. The liner tape 35 is pulled off the adhesive tape 36 and guided around the return pulley 49 and from there back to the liner tape roll 33, where it is fixed by means of the outer leg 40 of the clamping bow 39. By means of the pivot mechanism 15, the adhesive tape carrier 12 is moved out of its position of rest upwards into its working position. Then the unit 7 is displaced in the working direction 8 from the initial position of rest 50 into an adjacent starting position 51 in which the end 22 of the web of paper 4 is forced against the pressing rail 21 by means of the support pulley 27. Then the unit 7 is moved in its working position 52 over the full width of the web of paper 4 on the guide rail 6. During this process, the cutting edge 22*a* is produced by the crosswise strip 28 being cut off the end 22 of the web of paper 4 and then the adhesive tape 36 is glued on this end 22 in such a way that part of the adhesive tape 36 projects over the cutting edge 22*a* of the web of paper, as can be seen in FIG. 4 in comparison to FIG. 3. The liner tape 35, which is pulled off the adhesive tape 36 during this cutting and application process, is wound up on the liner tape roll 33. Since the diameter of the adhesive tape roll 30 decreases during these operations, while the diameter of the liner tape roll 3 grows, the belt drive 34 has slippage for the speed differences to be balanced which would otherwise occur. The brake 31 serves to keep the adhesive tape 36 tensioned which is pulled off the adhesive tape roll 30 and supplied to the pressing pulley 41.

At the end of the cutting and application process, the unit 7 reaches its end position of rest 53, where the adhesive tape carrier 12 is moved from its working position into its position of rest by means of the pivot mechanism 15.

The cleanly cut end 22 of a web of paper 4, which is provided with an adhesive tape 36 that projects over the cutting edge 22*a*, can be butted together with an end, not provided with an adhesive tape, of another web of paper, i.e. the two ends to be joined by means of the adhesive tape 36 do not overlap each other. This kind of a connection is called a flying splice.

When the liner tape roll 33 is filled with liner tape 35, then the clamping bow 39 is pulled out of the liner tape roll 33. As the liner tape 35 is wound over the outer leg 40, there is some clearance between the roll 33 and the wound up liner tape 35 so that the latter can easily be removed from the roll 33.

The coating 21*a* on the underside of the pressing rail 21 serves to prevent the part of the adhesive tape 36 that projects over the cutting edge 22*a* to stick to the underside of the pressing rail 21.

What is claimed is:

1. An apparatus for cutting a web of paper (4), thus producing a cutting edge (22*a*), and for applying an adhesive tape (36) to the cutting edge (22*a*) of the web of paper (4), comprising a stand (1) having a horizontal guide rail (6), a receptacle (1*a*) for a roll of paper (2) comprising a web of paper (4) with an end (22), a cutter and applicator unit (7) which is displaceable on the guide rail (6) in a working direction (8) and which comprises a cutting device (24, 27) for producing a straight cutting edge (22*a*) at the end (22) of the web of paper (4), an adhesive tape carrier (12) having a wind-off device (29) for an adhesive tape roll (30), and a pressing device (41), disposed downstream of the cutting device (24, 27) referred to the working direction (8), for pressing the adhesive tape (36) which projects over the cutting edge (22*a*) on the end (22) of the web of paper (4);

wherein a pressing rail (21) for the end (22) of the web of paper (4) and the adhesive tape (36) is provided on the stand (1), the pressing device (41) cooperating with the pressing rail (21).

2. An apparatus according to claim 1, wherein the adhesive tape carrier (12) is mounted on a guide block (9), which is displaceable on the guide rail (6), to be pivoted into, and out of, a pressing position of the pressing device (41).

3. An apparatus according to claim 2, wherein the cutting device (24, 27) is mounted on the guide block (9).

4. An apparatus according to claim 2, wherein the adhesive tape carrier (12) is pivotable relative to the guide block (9) by means of a pivot mechanism (15).

5. An apparatus according to claim 1, wherein the pressing device is a pressing pulley (41).

6. An apparatus according to claim 5, wherein the pressing pulley (41) is drivable by a drive.

7. An apparatus according to claim 6, wherein the drive of the pressing pulley (41) is derived from a motion of displacement of the cutter and applicator unit (7).

8. An apparatus according to claim 1, wherein a wind-up device (32) for a liner tape (35) of the adhesive tape (36) is provided.

9. An apparatus according to claim 1, wherein the wind-off device (29) is coupled to be driven in rotation with a wind-up device (32).

10. An apparatus according to claim 8, wherein the wind-off device (29) is coupled with slippage to be driven in rotation with the wind-up device (32) by means of a belt drive (34).

11. An apparatus according to claim 1, wherein the cutting device comprises a support pulley (27) which cooperates with a cutting knife (24).

12. An apparatus according to claim 11, wherein the cutting knife (24) reaches into a peripheral groove (26) of the support pulley (27).

13. An apparatus according to claim 1, wherein the cutting device comprises a support pulley (27) which cooperates with a cutting knife (24) and is in pressing connection with the pressing rail (21).

14. An apparatus according to claim 1, wherein the pressing rail (21) is provided with an adhesive rejecting coating (21*a*).

15. An apparatus for cutting a web of paper (4), thus producing a cutting edge (22*a*), and for applying an adhesive tape (36) to the cutting edge (22*a*) of the web of paper (4), comprising a stand (1) having a horizontal guide rail (6), a receptacle (1*a*) for a roll of paper (2) comprising a web of paper (4) with an end (22), a cutter and applicator unit (7) which is displaceable on the guide rail (6) in a working direction (8) and which comprises a cutting device (24, 27) for producing a straight cutting edge (22*a*) at the end (22) of the web of paper (4), an adhesive tape carrier (12) having a wind-off device (29) for an adhesive tape roll (30), and a pressing device (41), disposed downstream of the cutting device (24, 27) referred to the working direction (8), for pressing the adhesive tape (36) which projects over the cutting edge (22*a*) on the end (22) of the web of paper (4);

wherein the adhesive tape carrier (12) is mounted on a guide block (9), which is displaceable on the guide rail (6), to be pivoted into, and out of, a pressing position of the pressing device (41).

16. An apparatus according to claim 15, wherein the pressing device is a pressing pulley (41).

17. An apparatus according to claim 16, wherein the pressing pulley (41) is drivable by a drive.

18. An apparatus according to claim 17, wherein the drive of the pressing pulley (41) is derived from a motion of displacement of the cutter and applicator unit (7).

19. An apparatus according to claim 15, wherein a wind-up device (32) for a liner tape (35) of the adhesive tape (36) is provided.

20. An apparatus according to claim 19, wherein the wind-off device (29) is coupled to be driven in rotation with the wind-up device (32).

21. An apparatus according to claim 20, wherein the wind-off device (29) is coupled with slippage to be driven in rotation with the wind-up device (32) by means of a belt drive (34).

22. An apparatus according to claim 15, wherein the cutting device comprises a support pulley (27) which cooperates with a cutting knife (24).

23. An apparatus according to claim 15, wherein a pressing rail (21) for the end (22) of the web of paper (4) and the adhesive tape (36) is provided on the stand (1), the pressing device (41) cooperating with the pressing rail (21), and wherein the cutting device comprises a support pulley (27) which cooperates with a cutting knife (24) and is in pressing connection with the pressing rail (21).

24. An apparatus for cutting a web of paper (4), thus producing a cutting edge (22*a*), and for applying an adhesive tape (36) to the cutting edge (22*a*) of the web of paper (4), comprising a stand (1) having a horizontal guide rail (6), a receptacle (1*a*) for a roll of paper (2) comprising a web of paper (4) with an end (22), a cutter and applicator unit (7) which is displaceable on the guide rail (6) in a working direction (8) and which comprises a cutting device (24, 27) for producing a straight cutting edge (22*a*) at the end (22) of the web of paper (4), an adhesive tape carrier (12) having a wind-off device (29) for an adhesive tape roll (30), and a pressing device (41), disposed downstream of the cutting device (24, 27) referred to the working direction (8), for pressing the adhesive tape (36) which projects over the cutting edge (22*a*) on the end (22) of the web of paper (4);

wherein the pressing device is a pressing pulley (41);

wherein the pressing pulley (41) is drivable by a drive;

wherein the drive of the pressing pulley (41) is derived from a motion of displacement of the cutter and applicator unit (7).

25. An apparatus according to claim 24, wherein a pressing rail (21) for the end (22) of the web of paper (4) and the adhesive tape (36) is provided on the stand (1), the pressing device (41) cooperating with the pressing rail (21).

26. An apparatus according to claim 25, wherein the cutting device comprises a support pulley (27) which cooperates with a cutting knife (24).

27. An apparatus according to claim 25, wherein a pressing rail (21) for the end (22) of the web of paper (4) and the adhesive tape (36) is provided on the stand (1), the pressing device (41) cooperating with the pressing rail (21); and wherein the cutting device comprises a support pulley (27) which cooperates with a cutting knife (24) and is in pressing connection with the pressing rail (21).

28. An apparatus according to claim 24, wherein a wind-up device (32) for a liner tape (35) of the adhesive tape (36) is provided.

29. An apparatus according to claim 28, wherein the wind-off device (29) is coupled to be driven in rotation with the wind-up device (32).

30. An apparatus according to claim 29, wherein the wind-off device (29) is coupled with slippage to be driven in rotation with the wind-up device (32) by means of a belt drive (34).

31. An apparatus for cutting a web of paper (4), thus producing a cutting edge (22*a*), and for applying an adhesive tape (36) to the cutting edge (22*a*) of the web of paper (4), comprising a stand (1) having a horizontal guide rail (6), a receptacle (1*a*) for a roll of paper (2) comprising a web of paper (4) with an end (22), a cutter and applicator unit (7) which is displaceable on the guide rail (6) in a working direction (8) and which comprises a cutting device (24, 27) for producing a straight cutting edge (22*a*) at the end (22) of the web of paper (4), an adhesive tape carrier (12) having a wind-off device (29) for an adhesive tape roll (30), and a pressing device (41), disposed downstream of the cutting device (24, 27).referred to the working direction (8), for pressing the adhesive tape (36) which projects over the cutting edge (22*a*) on the end (22) of the web of paper (4);

wherein the cutting device comprises a support pulley (27) which cooperates with a cutting knife (24).

32. An apparatus according to claim 31, wherein the pressing device is a pressing pulley (41).

33. An apparatus according to claim 32, wherein the pressing pulley (41) is drivable by a drive.

34. An apparatus according to claim 33, wherein the drive of the pressing pulley (41) is derived from a motion of displacement of the cutter and applicator unit (7).

35. An apparatus according to claim 31, wherein a wind-up device (32) for a liner tape (35) of the adhesive tape (36) is provided.

36. An apparatus according to claim 35, wherein the wind-off device (29) is coupled to be driven in rotation with the wind-up device (32).

37. An apparatus according to claim 36, wherein the wind-off device (29) is coupled with slippage to be driven in rotation with the wind-up device (32) by means of a belt drive (34).

38. An apparatus according to claim 31, wherein a pressing rail (21) for the end (22) of the web of paper (4) and the adhesive tape (36) is provided on the stand (1), the pressing device (41) cooperating with the pressing rail (21); and wherein the cutting device comprises a support pulley (27) which cooperates with a cutting knife (24) and is in pressing connection with the pressing rail (21).

* * * * *